US007725954B2

(12) United States Patent
DelPrete et al.

(10) Patent No.: US 7,725,954 B2
(45) Date of Patent: Jun. 1, 2010

(54) PACIFIER RETAINING DEVICE

(76) Inventors: Lisa DelPrete, 11615 NE. 20th Dr., North Miami, FL (US) 33181; Stephen DelPrete, 11615 NE. 20th Dr., North Miami, FL (US) 33181

( * ) Notice: Subject to any disclaimer, the term of this patent is extended or adjusted under 35 U.S.C. 154(b) by 326 days.

(21) Appl. No.: 11/801,943

(22) Filed: May 10, 2007

(65) Prior Publication Data

US 2008/0276431 A1 Nov. 13, 2008

(51) Int. Cl.
*A41B 13/06* (2006.01)
*A41B 13/08* (2006.01)

(52) U.S. Cl. ..... 2/69.5; 2/111

(58) Field of Classification Search ..... 2/69.5, 2/49.1, 80, 75, 111, 94, 101; 224/638, 639; 606/234; 24/3.13
See application file for complete search history.

(56) References Cited

U.S. PATENT DOCUMENTS

| | | | | | |
|---|---|---|---|---|---|
| 3,184,883 | A | * | 5/1965 | McCook | 446/28 |
| 3,392,729 | A | | 7/1968 | Lenoir | |
| 4,096,977 | A | * | 6/1978 | Barville et al. | 224/148.6 |
| 4,564,957 | A | * | 1/1986 | Scharf | 2/75 |
| 4,765,037 | A | | 8/1988 | Perry | |
| 4,903,698 | A | | 2/1990 | Huber | |
| 4,947,489 | A | * | 8/1990 | Greenwood | 2/304 |
| 4,972,980 | A | | 11/1990 | Parsons | |
| 4,975,987 | A | * | 12/1990 | Teachout et al. | 2/246 |
| 4,985,968 | A | | 1/1991 | Hooper | |
| 4,990,157 | A | | 2/1991 | Roberts | |
| 4,994,075 | A | | 2/1991 | Smith | |
| 5,131,096 | A | | 7/1992 | Olson | |
| 5,150,504 | A | | 9/1992 | Cohen | |
| 5,440,761 | A | * | 8/1995 | Abrams et al. | 2/102 |
| 5,459,903 | A | * | 10/1995 | Treacy | 24/3.13 |
| 5,722,094 | A | * | 3/1998 | Ruefer | 2/69.5 |
| 5,948,003 | A | | 9/1999 | Shefflin | |
| 6,209,134 | B1 | * | 4/2001 | Schiesel | 2/102 |
| 6,312,449 | B1 | * | 11/2001 | Chang et al. | 606/234 |
| 6,434,797 | B1 | | 8/2002 | Sagman | |
| 6,638,298 | B1 | | 10/2003 | Shefflin | |
| 2004/0244153 | A1 | | 12/2004 | Lippincott | |
| 2005/0159779 | A1 | | 7/2005 | Schwartz | |

* cited by examiner

*Primary Examiner*—Gary L Welch
*Assistant Examiner*—Amber R Anderson
(74) *Attorney, Agent, or Firm*—Mark Terry

(57) ABSTRACT

An apparatus for retaining a pacifier within reach of a mouth of a child is disclosed. The apparatus includes a cord connected at both ends to a garment, wherein a first end of the cord is detachably coupled to the garment so as to allow the insertion of the cord into a pacifier ring when the first end of the cord is detached from the garment. The cord may be positioned horizontally across a chest area of the child's garment, such that a midpoint of the cord is located substantially on a midpoint of the garment. Further, the cord may be an elastic cord covered in an inelastic fabric. Also, the first end of the cord may be a piece of hook and loop fabric for coupling with a hook and loop fabric on the garment.

16 Claims, 4 Drawing Sheets

PACIFIER RETAINING DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The invention disclosed broadly relates to the field of accessories for infants and toddlers, and more particularly relates to pacifiers and sleepwear for infants and toddlers.

BACKGROUND OF THE INVENTION

Pacifiers for infants and toddlers, as well as the devices that retain the pacifiers within proximity of the child, have been around for ages. A pacifier is a usually nipple-shaped device for babies to suck or bite on. A pacifier retaining devices is typically a cord, strap or string-like device that provides a means for securing a pacifier within an infant's reach. Pacifier retaining devices are often attached to the child's clothing. Because pacifier retaining devices usually attach a pacifier to the child's clothing, the child is provided easy access to the pacifier and can choose to use it whenever he pleases. Also, pacifier retaining devices prevent a pacifier from dropping to the floor less often, keeping the pacifier more sanitary. Further, the pacifier is lost less often, reducing irritation by the child or the guardian.

A conventional pacifier retaining device includes a pacifier attached to a strap, or a cord, which is further fastened to a child's clothing via a clamp, clip or snap lock for detachable attachment to the clothing of an infant. FIG. 1 is an illustration of a conventional pacifier retaining device 100 comprising a pacifier 102 attached to a cord 104 for fastening to a child's garment 108 via a removable clip 106.

One problem with conventional pacifier retaining devices is the length of the cord 104. FIG. 1 shows the pacifier 102 hanging downwards the entire length of the cord 104. The length of the cord 104 may be too long, not allowing the pacifier to be within reach of the infant's mouth or hands. Additionally, the cord 104 is usually static or inelastic, which limits the versatility of the device. Further, element 110 shows that the length of the cord 104 allows the pacifier 102 to be pulled upwards the same length, which can be a strangulation hazard to the child. Thus, the cord 104 can be shortened to reduce the strangulation hazard and the clip 106 must be secured to the upper front portion of the baby's garment 108. As the baby rolls over during the night, however, the clip 106 can press into the baby's soft skin. To prevent this, most pacifier retaining devices must be removed during the night. If a child removes or loses his pacifier during the night, however, the child can become aggravated, thereby requiring the guardian to attend to the child. Thus, this type of pacifier retaining device 100 has its drawbacks.

Another problem with pacifier retaining devices is attachment to a child's garment. Typically, the pacifier retaining device cannot be attached to the child's garment at the optimal location—the midpoint of the child's chest—because of the existence of a zipper or a set of buttons at the midpoint of the garment worn by the child. FIG. 1 shows that the garment 108 includes a zipper 112 located at the midpoint of the child's chest, thereby preventing the pacifier retaining device 100 from being attached at this location. Yet another problem with pacifier retaining devices is interference with other child accessories. As the number of accessories available to infants and toddlers increase, parents are using more accessories on their children, thereby increasing the chance of interference between accessories or cluttering the child with items.

Therefore, a need exists to overcome the problems with the prior art as discussed above, and particularly for a more efficient way to maintain a pacifier within reach of a baby's mouth while not interfering with the child's sleep or other child accessories.

SUMMARY OF THE INVENTION

Briefly, according to an embodiment of the present invention, an apparatus for retaining a pacifier within reach of a mouth of a child is disclosed. The apparatus includes a cord connected at both ends to a garment, wherein a first end of the cord is detachably coupled to the garment so as to allow the insertion of the cord into a pacifier ring when the first end of the cord is detached from the garment.

In another embodiment of the present invention, an apparatus for retaining a pacifier within reach of a mouth of a child is disclosed. The apparatus includes a cord positioned horizontally across a chest area of a child's garment, such that a midpoint of the cord is located substantially on a midpoint of the garment. The apparatus further includes a first end of the cord coupled to the garment and a second end of the cord detachably coupled to the garment. The apparatus further includes a pacifier including a pacifier ring, wherein the cord is inserted into the pacifier ring when the second end of the cord is detached from the garment and wherein the pacifier is positioned at substantially the midpoint of the cord.

In another embodiment of the present invention, a garment for a child is disclosed. The garment includes a sack comprising two openings for arms, an opening for a head and a detachable seam along a midline of the sack. The garment further includes a cord positioned horizontally across a chest area of the sack such that a midpoint of the cord is located substantially on a midpoint of the sack. The garment further includes a first end of the cord coupled to a first side of the midline and a second end of the cord detachably coupled to a second side of the midline, so as to allow the insertion of the cord into a pacifier ring when the second end of the cord is detached from the sack.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

The present invention provides a simplified apparatus for retaining a pacifier within reach of a mouth of a child is disclosed. Because the apparatus includes a detachable cord positioned horizontally across a chest of the child, the apparatus allows for the quick and easy removal of a pacifier from the apparatus so as to allow for cleaning and replacement of the pacifier. The apparatus of the present invention can also be easily integrated with a child garment, such as a sleep sack, so as to blend in with the child's garment and not interfere with other accessories. Furthermore, because the cord of the present invention is connected to the child's garment at both ends, the pacifier attached to the cord is kept closer to the child's mouth and therefore more accessible. Also, because the cord connecting the pacifier to the apparatus can be elastic, the apparatus is given more freedom to move about the connection point, thereby providing a more versatile apparatus.

Lastly, because the cord of the present invention is placed horizontally across the garment, the cord is located horizontally across the chest of the child wearing the garment. Further, the midpoint of the cord is located substantially on a midpoint of the garment, such that the midpoint of the cord is located substantially at the midpoint of the chest of the child wearing the garment. This allows the pacifier attached to the cord to be placed near the child's mouth at the midpoint of the chest of the child. This is beneficial as it safely places the pacifier within easy reach of the child's mouth and hands while not interfering with any zippers or fasteners.

Figure 1:
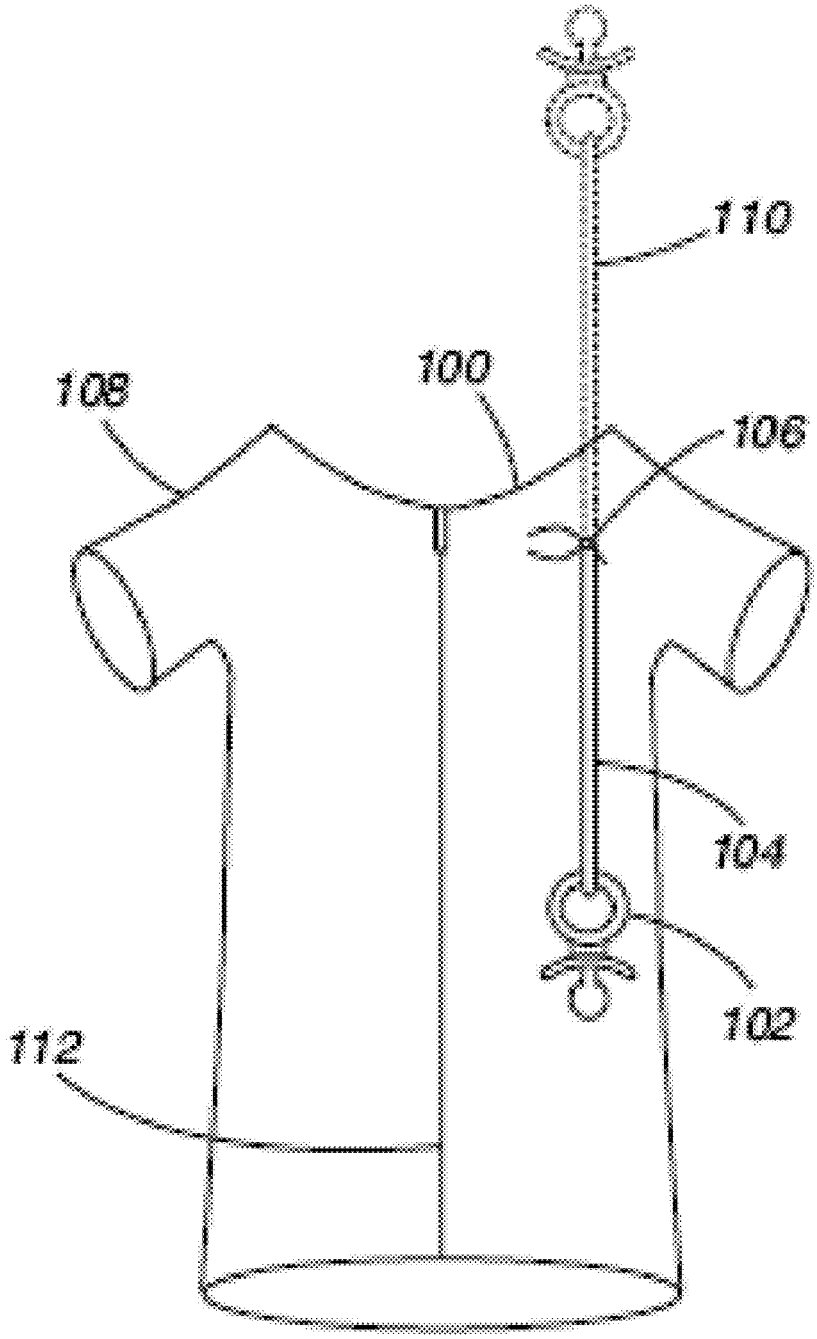
PRIOR ART FIG. 1
FIG. 1 is an illustration of conventional pacifier retaining device.
Figure 2:
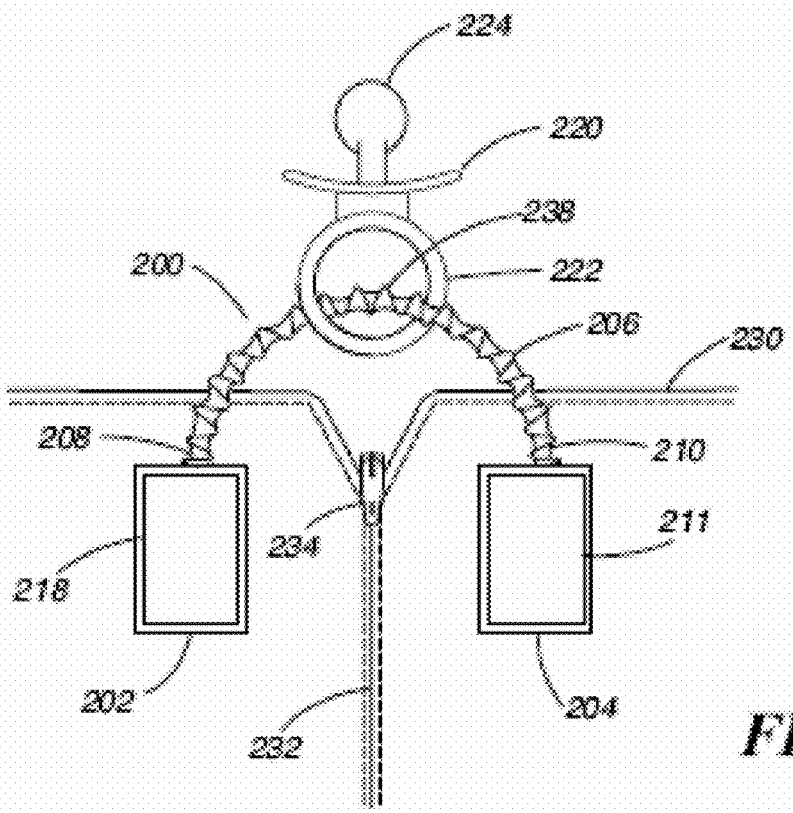
FIG. 2 is an illustration of a frontal view of the pacifier retaining device according to one embodiment of the present invention.

FIG. 2 is an illustration of a frontal view of the pacifier retaining device 200 according to one embodiment of the present invention. Pacifier retaining device 200 is coupled to the upper front portion of a torso garment 230 for a child, such as a shirt, a top, a sleep sack or a sweater. Pacifier retaining device 200 includes a cord 206 positioned horizontally across the garment 230 such that the cord 206 is located horizontally across the chest of the child wearing the garment 230. Further note that the midpoint 238 of the cord 206 is located substantially on a midpoint 232 of the garment 230, such that the midpoint 238 of the cord is located substantially at the midpoint of the chest of the child wearing the garment 230. A zipper 234 or other fastener is located along midpoint 232 of the garment 230 so as to create a detachable seam along the midpoint 232.

The cord 206 may comprise an elastic material such as an elastic fabric. Examples of an elastic fabric include spandex or elastane, which is a synthetic fiber known for its elasticity. Spandex or elastane is a manufactured fiber in which the fiber-forming substance is a long chain synthetic polymer comprised of at least 85 percent of a segmented polyurethane. Spandex is spun from a block copolymer and its fibers exploit the high crystallinity and hardness of polyurethane segments, yet remain rubbery due to alternating segments of polyethylene glycol. Another example of an elastic fabric includes a synthetic blend fiber fabric exhibiting elastic characteristics. The cord 206 may further comprise an elastic material covered in a substantially inelastic fabric. Such an inelastic fabric can be a woven or non-woven fabric comprising, cotton, cotton blend, synthetic, or synthetic blend of material.

The cord 206, which is from about 3 inches to about 10 inches in length, is attached at a first end 208 to a first piece of fabric 202. First end 208 is attached to the top of first piece of fabric 202 via a stitching 218. The first piece of fabric 202 may comprise a substantially inelastic fabric. The first piece of fabric 202 may further be stitched onto a first side, i.e., the left side, of the garment 230. Note that although FIG. 2 shows first end 208 attached to the top of first piece of fabric 202 the first end 208 can be attached to any location on fabric 202.

The cord 206 is further attached at a second end 210 to a second piece of fabric 204. Second end 210 is attached to the top of second piece of fabric 204 via a stitching 211. Stitching 218 and 211 may comprise a variety of stitches including backstitching, topstitching, basting, a running stitch and an overcast stitch. The second piece of fabric 204 may comprise a substantially inelastic fabric. The second piece of fabric 204 may further be stitched onto a second side, i.e., the right side, of the garment 230. Note that first piece of fabric 202 and second piece of fabric 204 are collinear and horizontal across the garment 230 so as to be located horizontally across the chest of the child wearing the garment 230. Note also that although FIG. 2 shows second end 210 attached to the top of second piece of fabric 204 the second end 210 can be attached to any location on fabric 204.

FIG. 2 further shows a pacifier 220 comprising a pacifier ring 222 and a sucking device 224. The sucking device 224 may be comprised of natural or synthetic rubber. Synthetic rubber is made through the polymerization of a variety of monomers to produce polymers. Natural rubber is essentially a polymer of isoprene units, a hydrocarbon diene monomer. The remaining portions of pacifier 220, including the pacifier ring 222, may be comprised of a plastic material. Plastic covers a range of synthetic or semisynthetic polymerization products. Plastics are composed of organic condensation or addition polymers and may contain other substances to improve performance or economics. In the present invention, plastic may comprise any one of the following forms of plastic: polyethylene, polystyrene, high impact polystyrene, polyethylene terephthalate and polyvinylidene chloride.

In the embodiment of FIG. 2, the pacifier 220 is attached to the cord 206 via a detachable pacifier ring 222 that opens and closes so as to allow the pacifier 220 to be attached, removed and re-attached to allow for cleaning and replacement of the pacifier 220.

It should be noted that although FIG. 2 shows the cord 206 being attached to the garment 230 via pieces of fabric 202, 204 that are stitched to the garment 230, the present invention supports other types of fasteners that fasten the cord 206 to the garment 230. Other types of fasteners include snaps, clips, clamps, buttons, magnets and rivets of the metallic or plastic kind.

It should further be noted that although the cord 206 is shown positioned horizontally across the garment 230 such that the cord 206 is located horizontally across the chest of the child wearing the garment 230, the present invention supports other locations for placement of the pacifier retaining device 200. For example, the pacifier retaining device 200 can be located vertically or diagonally across the garment 230 and/or the pacifier retaining device 200 can be located on the side of the garment 230.

Figure 3:
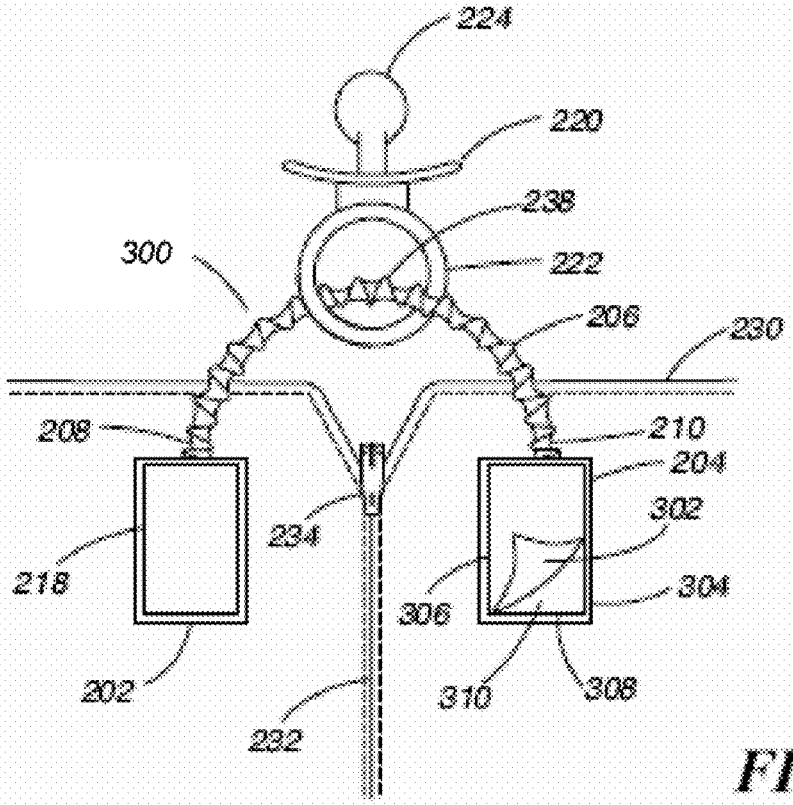
FIG. 3 is an illustration of a frontal view of another embodiment of the pacifier retaining device according to one embodiment of the present invention.

FIG. 3 is an illustration of a frontal view of another embodiment of the pacifier retaining device 300 according to one embodiment of the present invention. FIG. 3 is almost identical to FIG. 2 except for the detachable nature of the second piece of fabric 204. FIG. 3 shows that second piece of fabric 204 may comprise a substantially inelastic fabric. Further, second piece of fabric 204 is not attached to the garment 230 directly via stitching. Second piece of fabric 204 does, however, include stitching 306, which serves to attach second end 210 of the cord to the second piece of fabric 204.

On the back surface of second piece of fabric 204 is attached a layer of fabric 302 that comprises one layer of a hook and loop fastener. Layer of fabric 302 may be attached to the back surface of second piece of fabric 204 via stitching 306. Hook and loop fasteners typically consist of two layers: a "hook" side, which is a piece of fabric covered with tiny plastic hooks, and a "loop" side, which is a piece of fabric covered with even smaller and "hairier" plastic loops. When the two layers are pressed together, the hooks catch in the loops and hold the two pieces of fabric together. When the layers are separated, the action makes a characteristic ripping sound. There are many variations to hook and loop fasteners, including the use of hooks on both layers.

FIG. 3 also includes a third piece of fabric 304 attached to the garment 230 via stitching 308. Third piece of fabric 304 includes a layer of fabric 310 that comprises one layer of a hook and loop fastener. Layer of fabric 310 may be attached to the third piece of fabric 304 via stitching 308. Layer of fabric 302 is detachably coupled to the layer of fabric 310 via the hook and loop fastening feature of the present invention. In this manner, second piece of fabric 204 is detachably coupled to the garment 230.

In another embodiment of the present invention, the present invention supports other types of detachable fasteners that detachably fasten the second piece of fabric 204 to the garment 230. Other types of detachable fasteners include snaps, clips, clamps, buttons, magnets and rivets of the metallic or plastic kind. Another type of detachable fastener includes a hook and loop set of fabrics, such as the type described above, combined with a snap at the center of the fabrics. In this embodiment, the second piece of fabric 204 includes a layer of hook and loop fabric including a snap placed within the layer. Additionally, the garment 230 includes another layer of hook and loop fabric including a snap placed within the layer. When the two layers of hook and loop fabric meet, the hook and loop fabric, as well as the snaps, interconnect and fasten the second piece of fabric 204 to the garment 230.

In yet another embodiment of the present invention, the first piece of fabric 202 is further detachable in the same manner as second piece of fabric 204. In this embodiment, the first piece of fabric 202 is not directly stitched to the garment 230. Rather, a fourth piece of fabric (not shown), having a layer of hook and loop fabric, is stitched to the garment 230. The first piece of fabric 202 also includes a layer of hook and loop fabric that is detachably coupled to the fourth piece of fabric.

Figure 4:
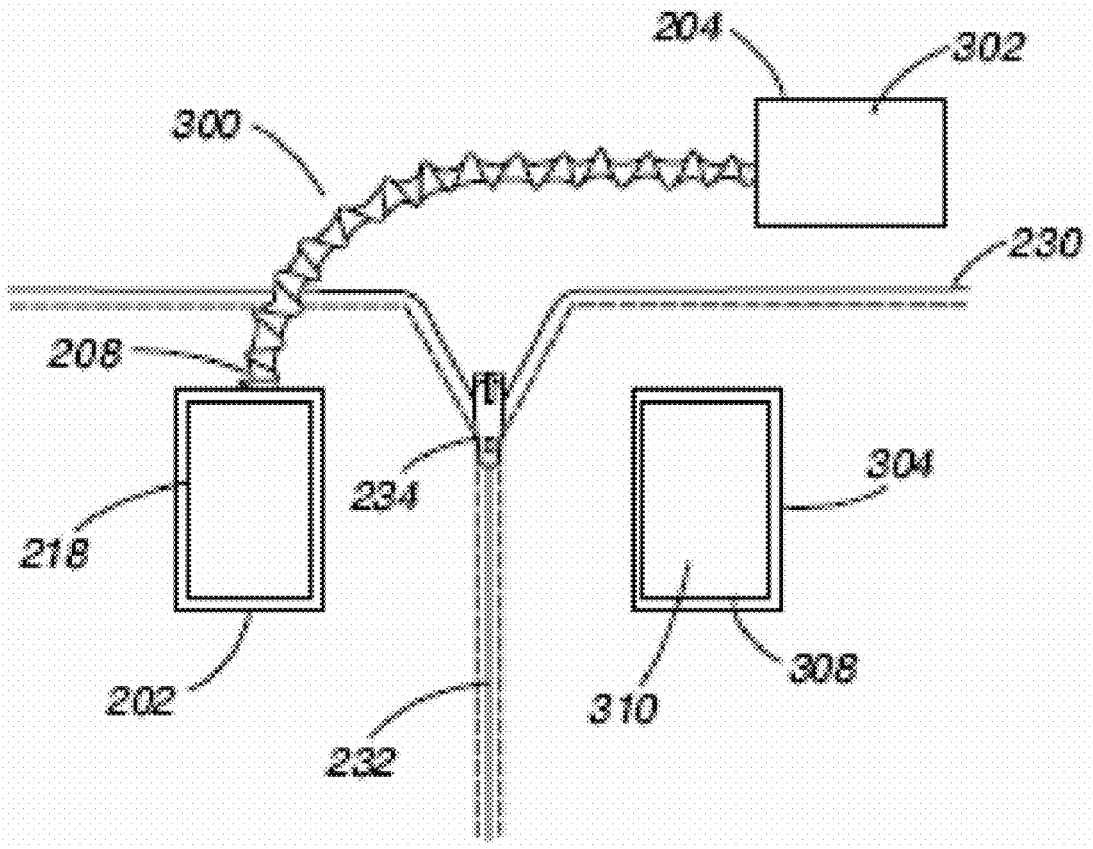
FIG. 4 is an illustration of a frontal view of the pacifier retaining device of FIG. 3.

FIG. 4 is an illustration of a frontal view of the pacifier retaining device 300 of FIG. 3. FIG. 4 shows the second piece of fabric 204 being completely detached from the garment 230. FIG. 4 further shows pacifier 220 being completely removed from the cord 206 since the second piece of fabric 204 was detached from the garment 230. This allows the pacifier 220 to be attached, removed and re-attached to the cord 206 to allow for cleaning and replacement of the pacifier 220.

Figure 5:
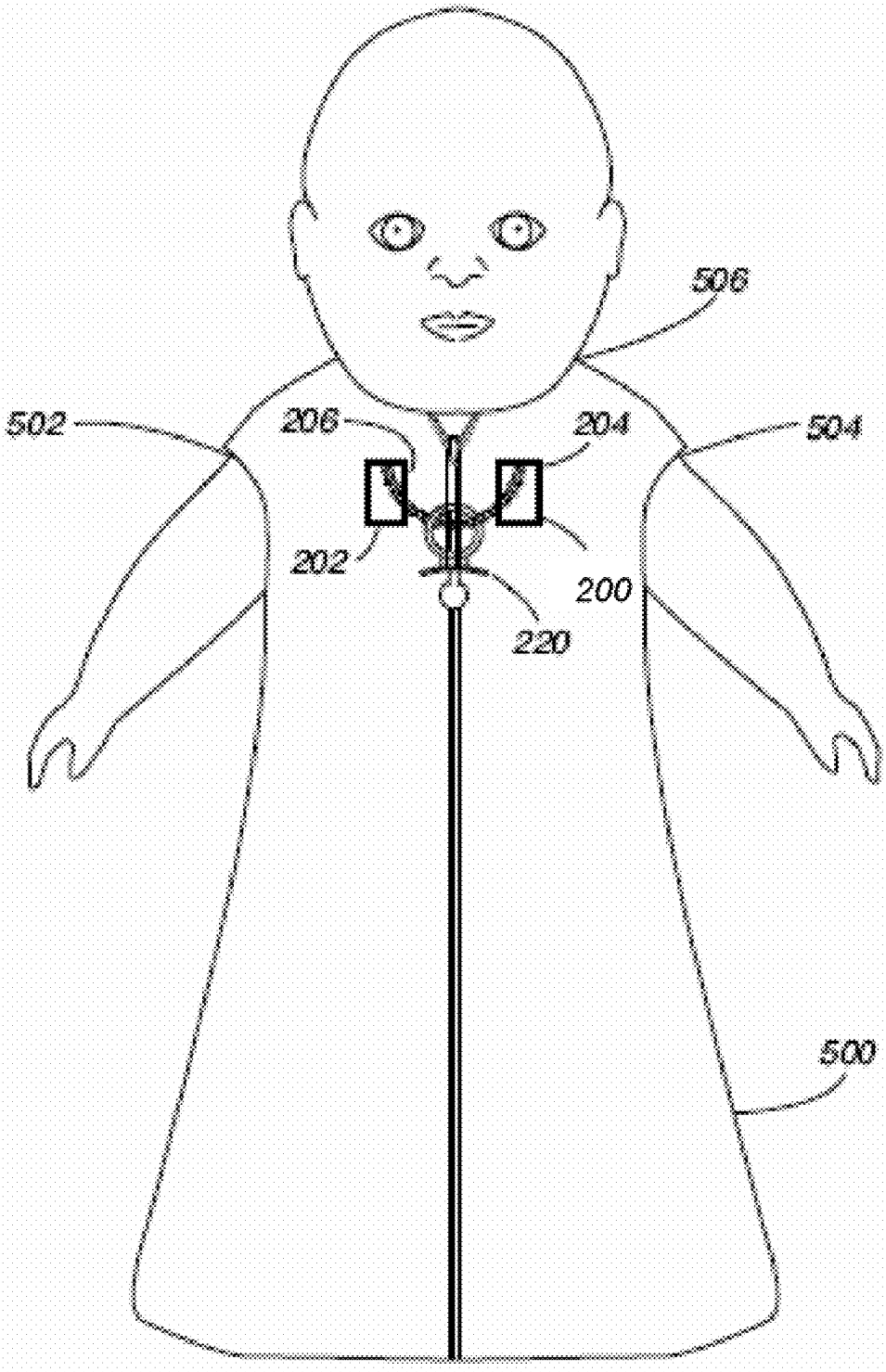
FIG. 5 is an illustration of a frontal view of a child's garment including the pacifier retaining device according to one embodiment of the present invention.

FIG. 5 is an illustration of a frontal view of a child's garment 500 including the pacifier retaining device 200 according to one embodiment of the present invention. The garment 500 shown in FIG. 5 is a sleep sack, which is a sleeping bag-like sleep-wear garment for children that doubles as bedding. Sleep sacks have recently been increasingly used as sleep-wear for children because of recent efforts by public interest groups to educate the public about the need to reduce the amount of bedding, i.e., sheets, covers, etc., in a baby's crib. As such, sleep sacks provide warmth for the wearer during sleep while eliminating the need for additional covers or blankets that may suffocate or cause injury to the child.

The sleep sack 500 of FIG. 5 includes a pair of openings 502, 504 on the sides of the garment 500 for the arms of the child, as well as central opening 506 for the child's neck and head. The sleep sack 500 also includes the pacifier retaining device 200 of FIG. 2, including the first piece of fabric 202, the cord 206, the second piece of fabric 204 and the pacifier 220.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

We claim:

1. An apparatus for retaining a pacifier within reach of a mouth of a child, comprising a garment, said garment having a top portion with a neck opening, two side portions having an arm opening in each side portion, a bottom portion, and front and back portions, said front portion having a symmetric left panel and right panel to define a midline with a fastener connecting said panels;

an elastic cord connected at both ends to each left and right panels of said garment at a location remote to said neck opening, wherein:

a first end of the elastic cord is detachably coupled to one of said left or right panels at a first attachment point so as to allow the insertion of the elastic cord into a pacifier ring when the first end is detached from the garment;

a second end of the elastic cord is coupled to other of said left or right panels at a second attachment point;

the length of the elastic cord is longer than the distance between the first and second attachment points;

a midpoint of the elastic cord lies substantially on said midline of said front portion and a midline of the child when the garment is worn by the child;

between the first and second ends, the elastic cord is free of any attachment to the garment, such that the elastic cord hangs freely between the first and second attachment points; and the midpoint of the elastic cord reaches a point above the attachment points without requiring detachment of the elastic cord from the garment.

2. The apparatus of claim 1, wherein the cord is positioned horizontally across a chest area of the child's garment, such that a midpoint of the elastic cord is located substantially over a sternum of the child when the garment is worn by the child.

3. The apparatus of claim 1, wherein the elastic cord comprises an elastic material covered in a non-elastic fabric.

4. The apparatus of claim 2, wherein the second end of the elastic cord is detachably coupled to the other of said left or right panels.

5. The apparatus of claim 2, wherein the second end comprises a first piece of non-elastic fabric stitched onto the other of said left or right panels.

6. The apparatus of claim 5, wherein the first end comprises a second piece of non-elastic fabric having a hook and loop fabric on one side.

7. The apparatus of claim 6, further comprising:

a third piece of fabric stitched onto the garment, wherein the third piece of fabric includes a hook and loop fabric on one side and wherein the hook and loop fabric of the second piece is coupled with the hook and loop fabric of the third piece.

8. An apparatus for retaining a pacifier within reach of a mouth of a child, comprising:

a garment, said garment having a top portion with a neck opening, two side portions having an arm opening in each side portion, a bottom portion, and front and back portions, said front portion having a symmetric left panel and right panel to define a midline with a fastener connecting said panels;

a pacifier comprising an elastic nipple for sucking by a child, a base portion for supporting the nipple and a ring coupled to the base portion;

an elastic cord connected at both ends to each left and right panels of said garment at a location remote to said neck opening, wherein:

a first end of the elastic cord is detachably coupled to the one of said left or right panels at a first attachment point so as to allow the insertion of the elastic cord into the ring when the first end is detached from the garment;

a second end of the elastic cord is coupled to the one of said left or right panels at a second attachment point;

the length of the elastic cord is longer than the distance between the first and second attachment points;

a midpoint of the elastic cord lies substantially on said midline of said front portion and a midline of the child when the garment is worn by the child;

between the first and second ends, the elastic cord is free of any attachment to the garment, such that the elastic cord hangs freely between the first and second attachment points; and the midpoint of the elastic cord reaches a point above the attachment points without requiring detachment of the elastic cord from the garment.

9. The apparatus of claim 8, wherein the second end is detachably coupled to the other of said left or right panels.

10. The apparatus of claim 8, wherein the second end comprises a first piece of non-elastic fabric stitched onto the other of said left or right panels.

11. The apparatus of claim 10, wherein the second end comprises a second piece of non-elastic fabric having a hook and loop fabric on one side.

12. The apparatus of claim 11, further comprising:

a third piece of fabric stitched onto the garment, wherein the third piece of fabric includes a hook and loop fabric on one side and wherein the hook and loop fabric of the second piece is coupled with the hook and loop fabric of the third piece.

13. A garment for a child, comprising:

a sack comprising two openings for arms, an opening for a head and front and back portions, said front portion having a symmetric left panel and right panel to define a midline with a fastener connecting said panels, such that legs of the child wearing the garment are encased in the sack;

an elastic cord connected at both ends to each left and right panels of said garment at a location remote to said neck opening, wherein:

a first end of the elastic cord is detachably coupled to the one of said left or right panels at a first attachment point so as to allow the insertion of the elastic cord into a pacifier ring when the first end is detached from the sack;

a second end of the elastic cord is coupled to the other of said left or right panels at a second attachment point;

the length of the elastic cord is longer than the distance between the first and second attachment points;

a midpoint of the elastic cord lies substantially on said midline of said front portion and a midline of the child when the sack is worn by the child;

between the first and second ends, the elastic cord is free of any attachment to the sack, such that the elastic cord hangs freely between the first and second attachment points; and the midpoint of the elastic cord reaches a point above the attachment points without requiring detachment of the elastic cord from the sack.

14. The garment of claim 13, wherein the second end comprises a first piece of non-elastic fabric stitched onto the other of said left or right panels.

15. The garment of claim 14, wherein the second end comprises a second piece of non-elastic fabric having a hook and loop fabric on one side.

16. The garment of claim 15, further comprising:

a third piece of fabric stitched onto the sack, wherein the third piece of fabric includes a hook and loop fabric on one side and wherein the hook and loop fabric of the second piece is coupled with the hook and loop fabric of the third piece.

* * * * *